United States Patent [19]

Gay-Chatain et al.

[11] 3,971,460

[45] July 27, 1976

[54] APPARATUS FOR ELECTRICALLY CONNECTING TWO CONDUCTORS BETWEEN TWO ROTATABLE ELEMENTS

[75] Inventors: Guillaume Antonin Gay-Chatain; Paul René Marius Montjallard, both of Saint-Etienne, France

[73] Assignee: Etat Francais, Paris, France

[22] Filed: Feb. 27, 1975

[21] Appl. No.: 553,547

[30] Foreign Application Priority Data

Mar. 5, 1974 France ..... 74.07348

[52] U.S. Cl. ..... 191/45 R; 339/5 R

[51] Int. Cl.[2] ..... H01R 39/64

[58] Field of Search ..... 191/12 R, 12.2 R, 45 R, 191/56, 59, 59.1, 60; 89/37 K, 36 K; 339/5 R, 5 A, 5 M, 5 RL, 6 R, 6 RL, 8 R, 8 RL; 114/6, 8; 200/26, 28, 48 A

[56] References Cited

UNITED STATES PATENTS

| | | | |
|---|---|---|---|
| 1,322,886 | 11/1919 | Edman | 339/5 R |
| 3,340,771 | 9/1967 | DeMeiss | 89/37 K |
| 3,596,225 | 7/1971 | Cary | 339/5 R |

*Primary Examiner*—Trygve M. Blix
*Assistant Examiner*—Reinhard J. Eisenzopf
*Attorney, Agent, or Firm*—Haseltine, Lake & Waters

[57] ABSTRACT

Electrical connection apparatus for two conductors respectively connected to an electrical supply source and to a utilization device, the conductors being respectively secured to first and second elements which are relatively rotatable with respect to one another through the intermediary of a roller bearing having a cage constituted by first and second parts respectively secured to the first and second elements and balls inserted in the cage. First and second conductive contacts are fixedly secured to the first element and are in rubbing contact respectively with a first annular grounding track and a second annular conductive track. The first and second tracks are fixedly secured to the second part of the cage, the grounding track being formed by a thin layer of low electrical resistance deposited in a peripheral groove in the second part of the cage.

10 Claims, 2 Drawing Figures

APPARATUS FOR ELECTRICALLY CONNECTING TWO CONDUCTORS BETWEEN TWO ROTATABLE ELEMENTS

FIELD OF THE INVENTION

The present invention relates to apparatus for electrically connecting two conductors between a voltage source and a utilization apparatus respectively fixed to two elements capable of turning with respect to one another through the intermediary of a bearing comprising at least two contacts rigid with one of the elements, one contact being in rubbing contact with an annular conductive track, the other contact being in rubbing contact with an annular grounded track, the two tracks being rigid with the other of said elements.

PRIOR ART

In the known apparatus of general type as defined above, and more particularly those utilized to feed direct current to apparatus fixed to a turret of a tank or the like from a feed source fixed in the interior of the turret, there is ordinarily provided a support which is a good electrical conductor, such as brass, fixed to one of the aforesaid elements and in electrical contact with the latter, an annular conductive track being fixed to this support via an electrical insulator, one surface of the support constituting an annular grounding track. The other element supports a first contact or wiper connected to the mass of the vehicle and thereby electrically grounded, said first contact being in rubbing contact with the grounded annular track, and a second contact coupled to the electrical source which is in rubbing contact with the conductive annular track.

The resulting construction is complicated and costly, requiring a great number of assembled elements, the elevated cost also being due in great part to the significant amount of brass which is necessary for utilization as the support of the annular tracks. It is necessary in fact to consider that for obvious reasons of convenience, the least complex and solid mounting dictates that the aforesaid support should be disposed at the extreme periphery on the element on which it is mounted, whereby its length and therefore its volume will be substantial.

SUMMARY OF THE INVENTION

An object of the present invention is to provide electrical connection apparatus of the above type which avoids these disadvantages and, particularly, reduces the cost and simplifies the manufacture of such apparatus.

In this respect the electrical connection apparatus of the invention contemplates that the annular grounded track is realized by the deposit on the roller cage which is rigid with said other element, of a thin layer of a low resistance material.

In this way, to make the conductive contacts rigid with one of the elements, there can be used an electrically nonconductive support, for example, of plastic material which is much less costly than a brass support while providing a grounded transmission cable between the grounded contact and the mass of the apparatus to be electrically supplied.

Because the annular grounding track is realized by the deposit on the bearing cage, it can be an extremely reduced volume and the deposit does not necessitate significant preliminary treatment operations to the roller cage. For example, the deposit can be effected in a small peripheral groove in the cage. Furthermore, this annular grounding track can be formed of brass without this leading to a significant expense of material.

Preferably, according to the invention, the annular conductive track is constituted by a ring of low resistance material fixed to the cage via an insulator.

Thanks to this additional arrangement in combination with the grounded track, it is not necessary to provide particular support means for the conductive annular track whereby there results a further diminution of the cost.

An embodiment is described hereafter by way of example and not of limitation, with reference to the figures in the annexed drawing.

DETAILED DESCRIPTION

Figure 1:
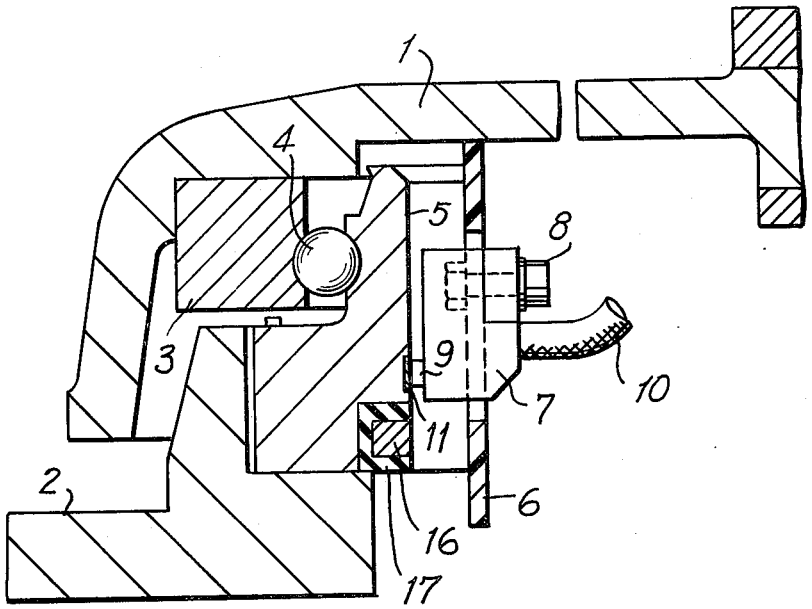
FIG. 1 is a partial view in axial half-section of a turret of a tank equipped according to the invention, principally showing the annular grounding track and the associated roller.

The tank which is not shown in entirety contains an electrical source of direct current, for example, of 24 V adapted to supply certain apparatus fixed in the turret such as the beacon light, the electromagnet for control of the machine gun (not shown) and the like.

In the drawing, the turret is shown at 1 and it constitutes one of the two elements mentioned hereinabove. The turret is capable of turning, with respect to the roof of the vehicle 2 which represents the other of the elements referred to hereinabove, through the intermediary of a ball-bearing assembly of elements 3, 4, 5, the latter being a roller cage rigid with roof 2.

Shown at 6 in FIG. 1 is a support fixed to the turret 1 on which a carrier 7, constituted of plastic material, is fixed by suitable attachment means such as bolts 8. The support 6 can also be constituted of plastic material. A wiper or conductor contact is shown at 9 and it is electrically connected to the ground of the apparatus to be electrically fed, for example, by a shielded conductor 10 or other suitable means electrically connected to contact 9.

The free extremity of the contact 9 is in rubbing contact, for example under the action of a spring (not shown) with an annular grounding track 11. This track is obtained by depositing on the roller cage 5, and more particularly in a peripheral groove of small depth in the cage centered on the axis of rotation of the turret with respect to the roof 2, a thin layer of a low resistance material such as brass. The deposit can be effected by casting or any other suitable procedure.

Figure 2:
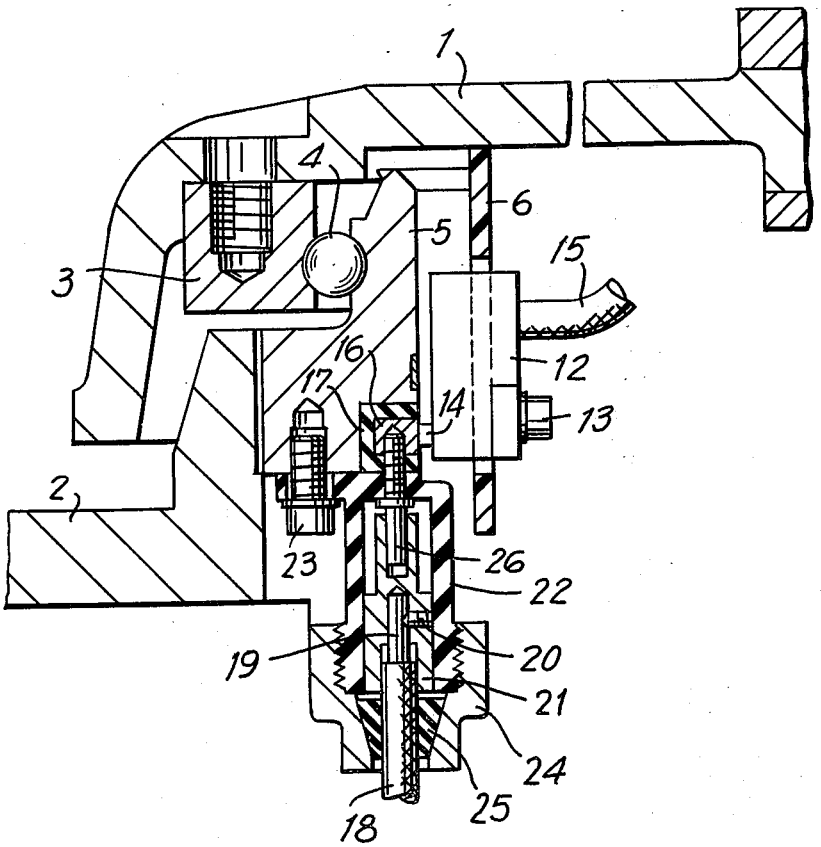
FIG. 2 is a partial view in axial half-section principally showing the current conductive track and the associated roller.

FIG. 2 shows that to the support 6 solid with the turret 1 is fixed a wiper support 12, whose body is made of plastic material, by attachment means such as bolts 13. The corresponding wiper or conductive contact is shown at 14 and it is electrically connected to a shielded reinforced conductor 15 connected to the supply terminals of the aforementioned utilization apparatus in the turret. The metallic mesh of the reinforced shielding of the conductor 15 is connected to ground to avoid parasitic currents which is particularly beneficial when the turret is equipped with a radio installation.

The free extremity of the conductor contact 14 is in rubbing contact, for example also under the action of a spring (not shown), with an annular conductive track. This track is constituted by a ring 16 of low resistance material, such as brass. The ring 16 is fixed in roller cage 5 with the interposition of an electrical insulator 17.

A shielded current conductor 18 is connected to the electrical source and to the annular conductive track 16 in the following manner. The bared extremity 19 of the conductor is secured by a screw 20 in a double female conductive element 21 mounted in an insulative connector 22 which is fixed to the cage 5 by a bolt 23. This connector is closed by a threaded cap 24 containing a frusto-conical rubber sealing member 25 which prevents any abrading of the sheath of conductor 18 and any entry of dust within insulative connector 22. Finally, the cylindrical head 26 of a terminal threaded into a tapped bore in the annular track 16 is engaged in the other extremity of the female conductive element 21.

There is thus obtained a sure and robust connection which is easily disassembled and reassembled.

As will be evident, and from what has already been stated, the invention is not at all limited to the embodiments which have been particularly described; it embraces in contrast, all variants thereof.

In particular, the supply contact and the ground contact could be mounted on a common support of plastic material instead of being separated:

What is claimed is:

1. Electrical connection apparatus for two conductors respectively connected to an electrical supply source and to a utilization device, the conductors being respectively secured to first and second elements which are relatively rotatable with respect to one another through the intermediary of a roller bearing having a cage constituted by first and second parts respectively secured to said first and second elements and balls inserted in said cage, said apparatus comprising first and second conductive contacts fixedly secured to said first element, an annular grounding track on which said first contact is in sliding contact, an annular conductive track on which said second contact is in sliding contact, said conductive track and said grounding track being secured to said second part of the cage.

2. Apparatus as claimed in claim 1 wherein said grounding track is constituted by a thin layer of a low resistance material.

3. Apparatus as claimed in claim 2 wherein said second part of the cage is provided with a peripheral groove within which said thin layer is disposed.

4. Apparatus as claimed in claim 1 wherein said conductive track is fixedly secured in said second part of the cage.

5. Apparatus as claimed in claim 4 wherein said conductive track is constituted by a ring of low resistance material disposed in said second part of the cage, an electrically insulative material being interposed between said ring of low resistance material and said second part of the cage.

6. Apparatus as claimed in claim 1 comprising insulative support means supporting said conductive contacts from said first element.

7. Apparatus as claimed in claim 6 wherein said insulative support means comprises a plastic support member.

8. Apparatus as claimed in claim 1 wherein said first element is a rotatable turret and said second element is an armored vehicle on which said turret is rotatably mounted.

9. Apparatus as claimed in claim 1 comprising means secured to said second element establishing electrical connection between said conductive track and the conductor connected to the electrical supply source.

10. Apparatus as claimed in claim 9 wherein the conductor connected to the utilization device is secured with said first element and is electrically connected to said second conductive contact, a grounding conductor being electrically connected to said first contact and thereby to said grounding track and electrical ground.

* * * * *